US005357665A

United States Patent [19]

Fukui et al.

[11] Patent Number: 5,357,665

[45] Date of Patent: Oct. 25, 1994

[54] APPARATUS FOR EXECUTING HEMMING PROCESS

[75] Inventors: Kuniaki Fukui; Norihiro Adachi, both of Aichi, Japan

[73] Assignee: Sanyo Machine Works, Ltd., Aichi, Japan

[21] Appl. No.: 93,960

[22] Filed: Jul. 21, 1993

[30] Foreign Application Priority Data

Feb. 19, 1993 [JP] Japan ..... 5-030176

[51] Int. Cl.[5] ..... B23P 11/00

[52] U.S. Cl. ..... 29/243.58; 29/243.5

[58] Field of Search ..... 29/243.5, 243.57, 243.58, 29/795, 796, 788, 509, 514, 521, 524; 72/181, 210, 220

[56] References Cited

U.S. PATENT DOCUMENTS

| | | | |
|---|---|---|---|
| 4,660,265 | 4/1987 | Pallmeyer | 29/243.5 |
| 5,184,384 | 2/1993 | Lipp | 29/243.5 |
| 5,224,253 | 7/1993 | Sawa | 29/243.5 |
| 5,243,748 | 9/1993 | Morello | 29/243.5 |

*Primary Examiner*—Robert C. Watson

*Attorney, Agent, or Firm*—Pollock, Vande Sande & Priddy

[57] ABSTRACT

The apparatus according to the invention separates a cam structure which activates operation of a pre-hemming structure used for supporting a blade available for preliminarily folding a hem flange into two units including a lower cam structure used for pressuring a movable member of the pre-hemming structure in the downwardly slant direction corresponding to the preliminary folding direction and an upper cam structure for activating operation of the lower cam structure. After completing the preliminary folding process against the hem flange, the upper cam structure is retracted to permit the lower cam structure to be free from pressuring force transmitted in the preliminary folding direction by the movable member. In consequence, the preliminary folding blade is securely prevented from repeatedly and uselessly being operated on the way of lifting an upper mold after completion of the hemming process.

4 Claims, 5 Drawing Sheets

APPARATUS FOR EXECUTING HEMMING PROCESS

BACKGROUND OF THE INVENTION

The present invention relates to an improved apparatus for executing a hemming process, which is capable of practically contracting cycle time in the execution of the hemming process.

In the course of manufacturing external plate bodies such as a hood, fenders, or side-doors, for assembling an automotive body, for example, a hem flange formed at an edge of an outer panel is folded backward to cause the folded-back hem flange to nip an edge of an inner panel so that both panels can eventually be combined with each other.

Conventionally, this method is called the "hemming process". Concretely, as shown in FIG. 5, a hem flange B is previously formed at an edge of an outer panel A by way of erecting it at a substantially right angle. Next, an edge of an inner panel C is superposed on the inner domain of the hem flange, and then a preliminary folding process is executed against the superposed hem flange by a predetermined folding angle by operating a preliminary-folding blade D. Finally, the superposed hem flange B is regularly folded by means of a regular folding blade E.

FIG. 6 is a lateral view of a conventional apparatus 1 for executing the hemming process, which executes the hemming process based on the method described below.

The reference numeral 3 shown in FIG. 6 designates a lower mold which is supported on a base 2. The reference numeral 4 designates an upper mold which is ascendably and descendably supported above the lower mold 3. The reference character A designates an outer panel which is previously furnished with a hem flange B and placed on the lower mold 3. The reference character C designates an inner panel which is loaded on the outer panel A.

The reference character D shown in FIG. 6 designates a preliminary folding blade which is disposed outside of the outer panel A via a pre-hemming structure 5. The reference character E designates a regular folding blade which is supported by the upper mold 4. The reference numerals 6 and 7 respectively designate a transmitting cam and a returning cam which are respectively held at specific positions above the pre-hemming structure 5 via a bracket 8 installed outside of the upper mold 4.

The pre-hemming structure 5 comprises a supporting frame 10 which is set to a position outside of the lower mold 3 mounted on the base 2 and a movable member 13 which is swingably supported by the supporting frame 10 via a pair of first and second links 11 and 12. The preliminary folding blade D is secured to the inner tip domain of the movable member 13.

The movable member 13 is externally drawn by the resilient force of a spring 14. Normally, the preliminary folding blade D is held in the state of being retracted to an upward position of the hem flange B of the outer panel A.

A roller 15 is rotatably supported by the first link 11 in order to swingably shift the movable member 13 in the direction of the hem flange B via own contact with the surface of the transmitting cam 6.

When the upper mold 4 descends in such a condition in which the outer panel A and the inner panel C are respectively set to the lower mold 3, initially, the surface of the transmitting cam 6 comes into contact with the roller 15 of the first link 11 of the pre-hemming structure 5 to cause the movable member 13 to shift itself in the preliminary folding direction (concretely, in the downward slant direction). As a result, the preliminary folding blade D at the tip of the movable member 13 comes into contact with the hem flange B to preliminarily fold the hem flange B by a predetermined folding angle.

When the upper mold 4 descends furthermore, the transmitting cam 6 leaves the roller 15 to cause the movable member 13 to be back to the initial position, thus causing the preliminary folding blade D to leave the hem flange as well.

Concretely, the returning cam 7 comes into contact with the roller 15 to bring the movable member 13 back to the initial position via functional effect of the returning cam 7. In consequence, the preliminary folding blade D is securely apart from the hem flange B.

When the upper mold 4 descends furthermore from the above-cited position, the regular folding blade E comes into contact with the hem flange B so that the hem flange B can fully be folded until closely being set to the inner panel C.

After completing the above-cited process for folding the hem flange B, the upper mold 4 is lifted so that it can be back to the initial position. Next, the outer and inner panels A and C complete with the hemming process are respectively drawn out of the lower mold 3 before eventually being delivered to the following process.

If it were aimed to contract cycle time in the hemming process and also contract cycle time in the operation of the whole production line equipped with a conventional hemming apparatus 1 based on the structure cited above, then, this conventional apparatus 1 still faces those technical problems to solve described below.

Concretely, when operating the pre-hemming structure 5 having the above structure to shift the preliminary folding blade D in the direction of the hem flange B, after completing a process for folding the hem flange B by lowering the upper mold 4, on the way of lifting the upper mold 4 back to the initial position, the transmitting cam 6 comes into contact with the roller 15 of the pre-hemming structure 5 to cause the movable member 13 of the pre-hemming structure 5 to again shift itself in the direction of the hem flange B. In other words, the movable member 13 ineffectively behaves itself.

Concretely, after completing the process to fold the hem flange B, if the upper mold 4 were lifted too fast, then, it will cause the pre-hemming structure 5 to perform a useless shifting operation. Therefore, any of these conventional hem-processing apparatuses cannot lift the upper mold 4 at a fast speed, and thus, there is a certain limit in terms of the capability to contract the operating cycle time.

In order to properly draw the outer and inner panels A and C complete with the hemming process from the lower mold 3, it is quite essential that enough space be secured between the lower and upper molds 3 and 4. However, since the transmitting cam 6 held by the bracket 8 substantially protrudes in the downward direction outer from the upper mold 4, in order to secure enough space between the lower and upper molds 3 and 4, it is quite essential for this conventional apparatus to extend the lifting stroke of the upper mold 4. This in turn obstructs the apparatus to contract cycle time in the execution of the hemming process.

SUMMARY OF THE INVENTION

Therefore, the invention provides an improved apparatus for executing a hemming process, wherein an inner panel is superposed on an outer panel and loaded on a lower mold, and wherein, availing of descending movement of an upper mold, a hem flange previously being formed at an edge of the outer panel is folded onto the inner panel by way of being superposed thereon.

The apparatus incorporates a pre-hemming structure which movably supports a preliminary-folding blade available for preliminarily folding a hem flange in the hem-flange preliminary-folding direction by operating a movable member which is movably held outside of a lower mold; a lower-cam structure comprising; a lower slide base, a lower slide which is ascendably and descendably held by a lower slide base and constantly pressurized in the upward direction, and a transmitting cam which is secured to the lower slider and pressurizes a movable member in the hem-flange preliminary-folding direction in association with descending movement of the lower slider; a regular folding blade secured to a predetermined position of an upper mold situated above the hem flange; an upper slide structure secured to a predetermined position of the upper mold situated above the lower cam structure, comprising an upper slide base and an upper slider which is slidably supported in the horizontal direction by the upper slide base and constantly pulled in the inward direction, where the bottom surface of the upper slider comes into contact with the top surface of the lower slider in association with descending movement of the upper mold performed for lowering the lower slider.

The lower slider and the upper slider are provided with a lower-sliding surface and an upper-sliding surface which respectively cause the upper slider to slide in the outward direction availing of descending movement of the upper mold of the upper slider after termination of a process for preliminarily folding the hem flange executed by the preliminary folding blade, thus, eventually causing the upper slider to leave the lower slider.

As described above, the improved apparatus according to the invention separates the cam structure that operates the pre-hemming structure supporting the hem-flange preliminary folding blade into two units including the lower-cam structure which pressurizes the movable member of the pre-hemming structure in the preliminary-folding direction and the upper-cam stucture available for operating the lower cam structure. After completing the preliminary folding process, the upper cam structure is retracted in order to disengage the lower cam structure from exerting pressure onto the movable member in the preliminary folding direction. In consequence, the preliminary-folding blade is prevented from being shifted over again while the upper mold ascends itself after completing the hemming process.

DESCRIPTION OF THE PREFERRED EMBODIMENTS

Figure 1:
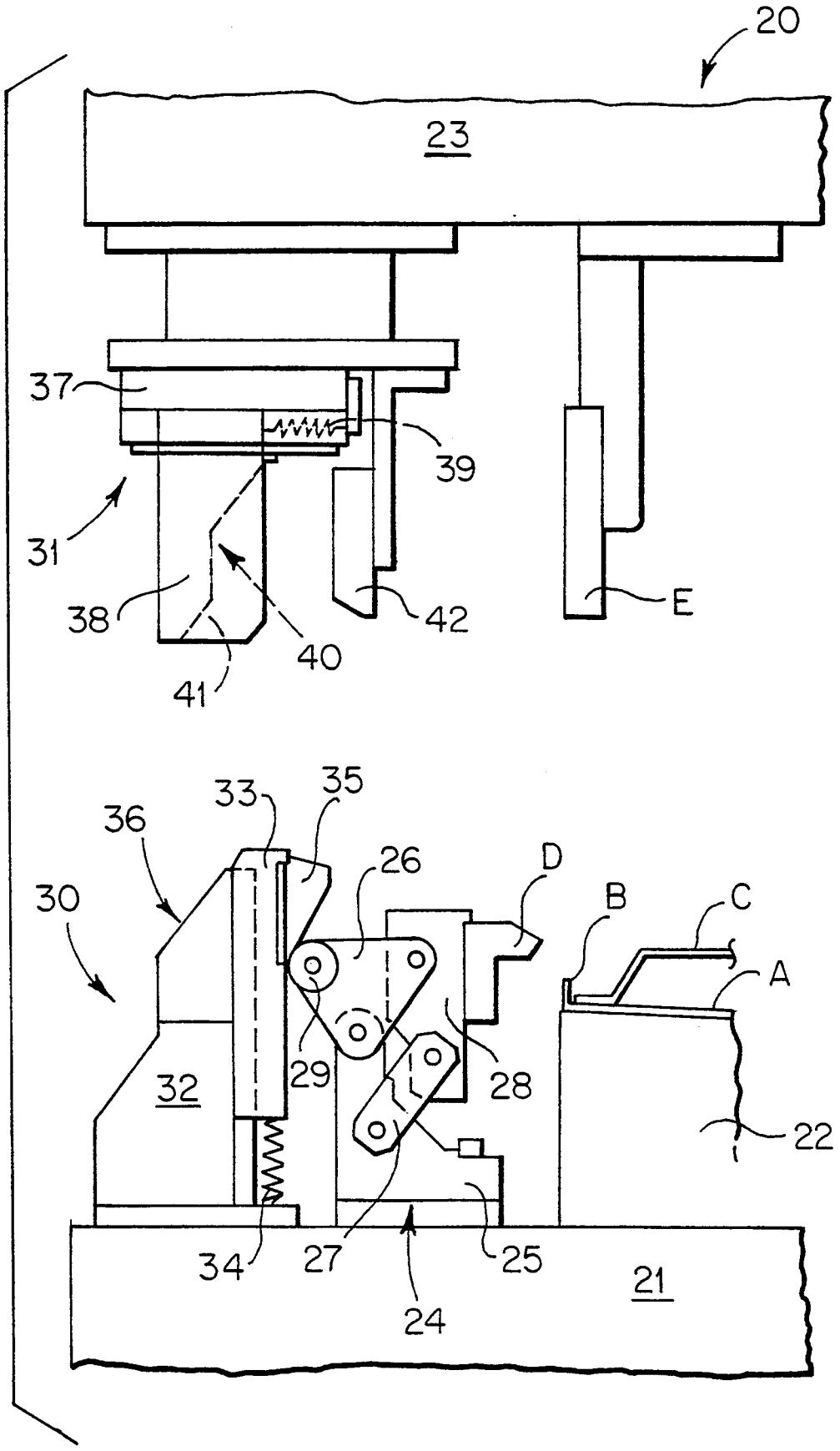
FIG. 1 is a schematic lateral view of the apparatus embodying the invention while the upper mold is at the peak of the lifting position.
Figure 2:
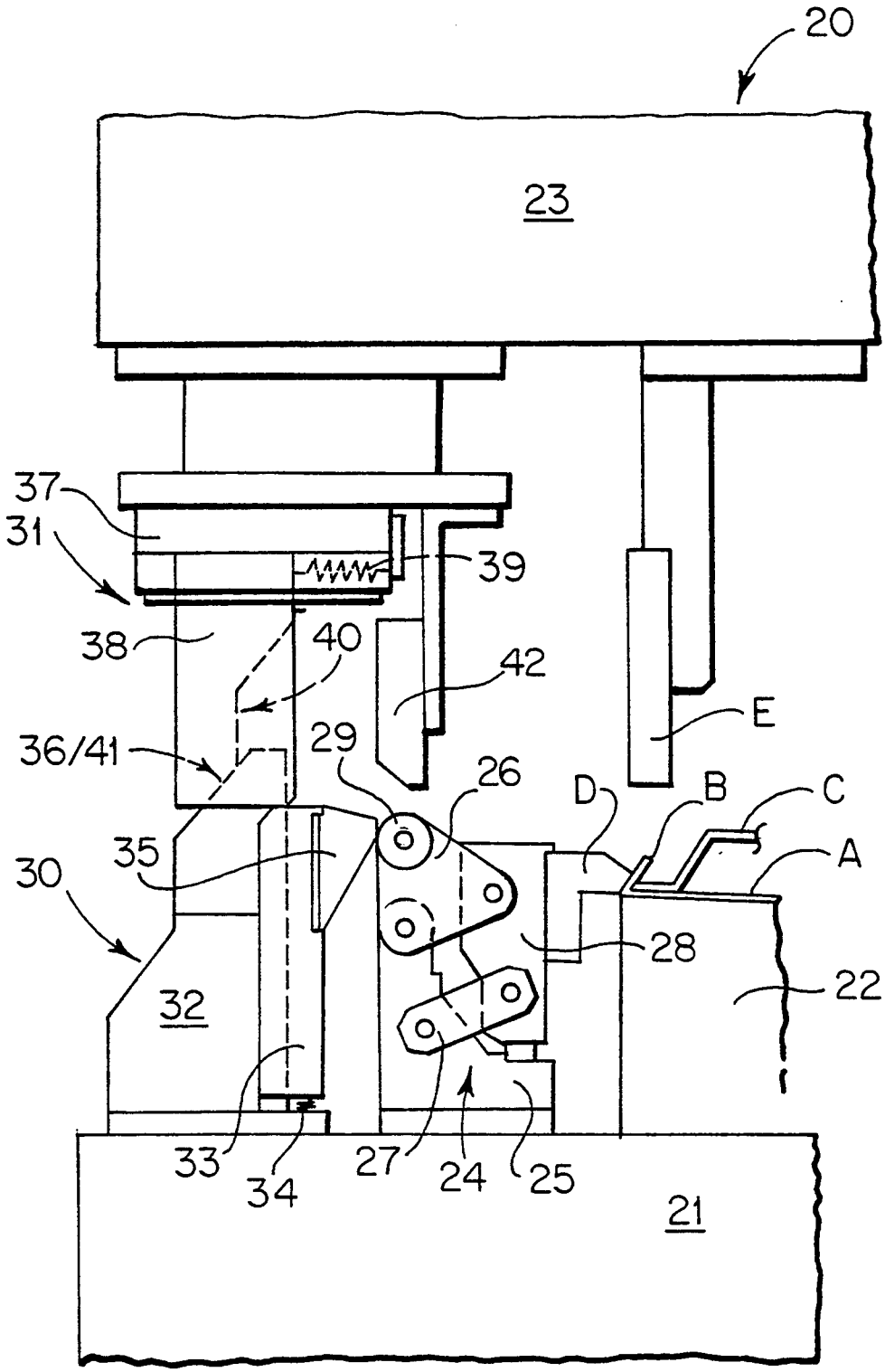
FIG. 2 is a schematic lateral view similar to FIG. 1 while the upper mold is at an intermediate position on the lift.
Figure 3:
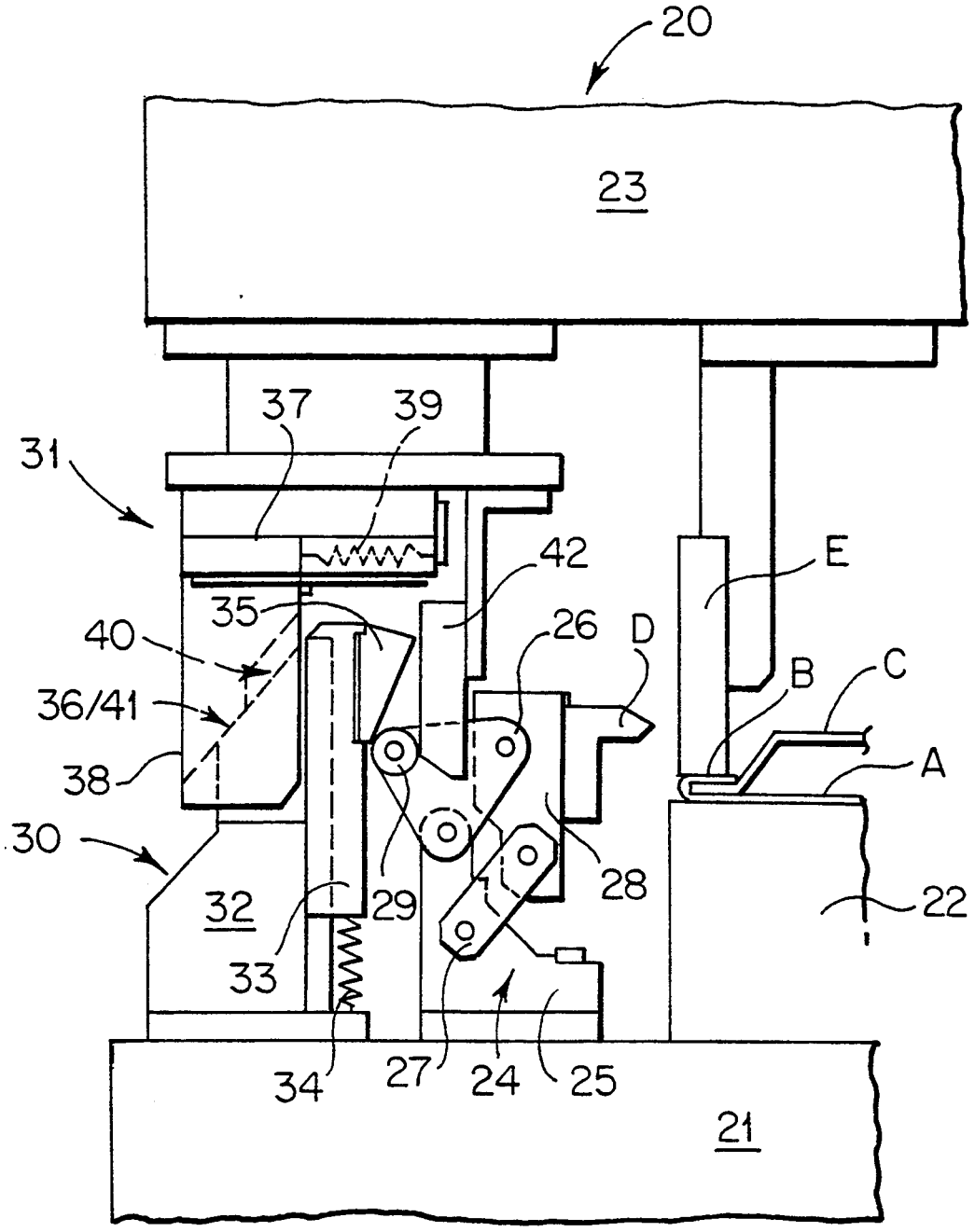
FIG. 3 is a schematic lateral view similar to FIGS. 1 and 2 while the upper mold is at the bottom position.

FIGS. 1 through 3 respectively illustrate lateral views of the improved apparatus for executing a hemming process related to the invention. The reference numerals 22 shown in FIGS. 1 through 3 designates a lower mold 22 which is supported on a base 21. The reference numeral 23 designates an upper mold which is ascendably and descendably held above the lower mold 22. The reference character A designates an outer panel which is loaded on the lower mold 22 and furnished with a previously formed hem flange B. The reference character C designates an inner panel which is loaded on the outer panel A. The reference character D designates a preliminary folding blade which preliminarily folds the hem flange B. The reference character E designates a regular folding blade which is secured to the upper mold 23. The reference numeral 24 designates a pre-hemming structure which is operated to dispose the preliminary folding blade D to an external side of the outer panel A.

The pre-hemming structure 24 comprises a supporting frame 25 which is secured to an external position of the lower mold 22 mounted on the base 21 and a movable member 28 which is swingably supported by the supporting frame 25 via a pair of first and second links 26 and 27. The preliminary folding blade D is secured to the inner tip domain of the movable member 28. The movable member 28 is constantly pulled in the outward direction by effect of resilient force of a spring (not shown). Normally, the preliminary folding blade D is held in the state of being retracted in the upward slant direction of the hem flange B of the outer panel A.

A roller 29 is rotatably held by the first link 26 in order to shift the movable member 28 in the downward slant direction corresponding to the preliminary folding direction upon coming into contact with the surface of a transmitting cam 35 to be described later on.

The reference numeral 30 designates a lower cam structure which is disposed outside of the pre-hemming structure 24 mounted on the base 21 in order to activate the pre-hemming structure 24 to shift the movable member 28 in the upward slant direction. The reference numeral 31 designates an upper cam structure which is disposed above the lower cam structure 30 by means of the upper mold 23.

The lower cam structure 30 comprises a lower slide base 32 which is erected on the base 21 and a lower slider 33 which is ascendably and descendably held inside of the lower slide base 32 by engaging its own slit domain with the inner surface of the lower slide base 32.

The lower slider 33 is biased in the upward direction by a spring 34. A transmitting cam 35 is secured to the upper inner domain of the lower slider 33, where the transmitting cam 35 comes into contact with the roller 29 of the pre-hemming structure 24 to shift the movable member 28 in the preliminary folding direction.

A lower cam surface 36 is formed on the top surface of the lower slide base 32, where the lower-cam surface 36 comes into contact with an upper cam surface 41 of an upper slider 38 to be described later on.

The upper cam structure 31 causing the lower slider 33 of the lower cam structure 30 to descend comprises an upper slide base 37 secured to the upper mold 23 and an upper slider 38 slidably being held in the horizontal direction by means of the upper slide base 37.

The upper slider 38 is constantly pulled in the inward direction by a spring 39. The upper slider 38 is provided with a slit 40 which is engages the external circumference of the lower slide base 32. The slit 40 internally contains an upper cam surface 41 which comes into contact with the lower cam surface 36 of the lower slide base 32. The upper cam structure 31 includes a returning cam 42.

When the upper mold 23 is lowered in such a state in which an outer panel A and an inner panel C are loaded on the lower mold 22 of the apparatus related to the invention, the bottom surface of the upper slider 38 comes into contact with the top surface of the lower slider 33 to depress the lower slider 33 in resistance against resilient force of the spring 34. On the other hand, the slit 40 inside of the upper slider 38 receives the lower slide base 32 supporting the lower slider 33.

Consequently, the surface of the transmitting cam 35 secured to the lower slider 33 comes into contact with the roller 29 of the pre-hemming structure 24 to pressure the movable member 28 in the preliminary folding (downward slant) direction to cause the movable member 28 to shift itself to the hem flange B, thus causing the preliminary-folding blade D at the tip of the movable member 28 to come into contact with the hem flange B. As a result, the hem flange B is preliminarily folded by a predetermined folding angle as shown in FIG. 2.

Then, as the upper mold 23 descends further, the upper cam surface 41 formed inside of the slit 40 of the upper slider 38 comes into contact with the lower cam surface 36 provided for the lower slide base 32, and thus, when the upper mold 23 descends further, the upper slider 38 slides itself in the outward direction along the lower cam surface 36.

When the bottom surface of the upper slider 38 leaves the top surface of the lower slider 33, the lower slider 33 and the transmitting cam 35 are lifted to be back to the initial position by effect of resilient force of the spring 34, thus causing the movable member 28 to also return to the initial position by effect of resilient force of a spring (not shown). In consequence, the preliminary folding blade D secured to the tip of the movable member 28 also leaves the hem flange B before being led back to the initial position as shown in FIG. 3.

Concurrently, the returning cam 42 comes into contact with the roller 29 of the pre-hemming structure 24. Since the movable member 28 is also brought back to the initial position via functional effect of the returning cam 42, the preliminary folding blade D securely leaves the hem flange B.

When the process for fully folding the hem flange B is completed according to those steps described above, the upper mold 23 is lifted to be back to the initial position. Finally, the outer panel A and the inner panel C complete with the hemming process are drawn out of the lower mold 22 to complete one cycle of the hemming process.

While the upper mold 23 ascends, the movable member 28 of the pre-hemming structure 24 is already back to the initial position. In other words, when the upper mold 23 ascends itself, only the upper slider 38 is brought back to the initial position by effect of resilient force of the spring 39. Therefore, the improved apparatus according to the invention can securely lift the upper mold 23 at a fast speed without fear of incurring unreasonable force to the pre-hemming structure 24.

As is identifiable from FIGS. 1 through 3, the invention provides the apparatus with the upper slider 38 which protrudes below the upper mold 23, the returning cam 42, and the tip of the regular folding blade E, by way of substantially being flush with each other. This in turn prevents any of those component members from excessively protruding downward. Therefore, even when contracting the stroke of the vertical movement of the upper mold 23, the apparatus according to the invention can secure substantial space between the upper and lower molds 23 and 22 enough to draw out the outer and inner panels A and C therethrough.

Therefore, owing to multiple functional effects based on those reasons described above, the apparatus embodied by the invention can securely contract cycle time during the hemming process.

Figure 4:
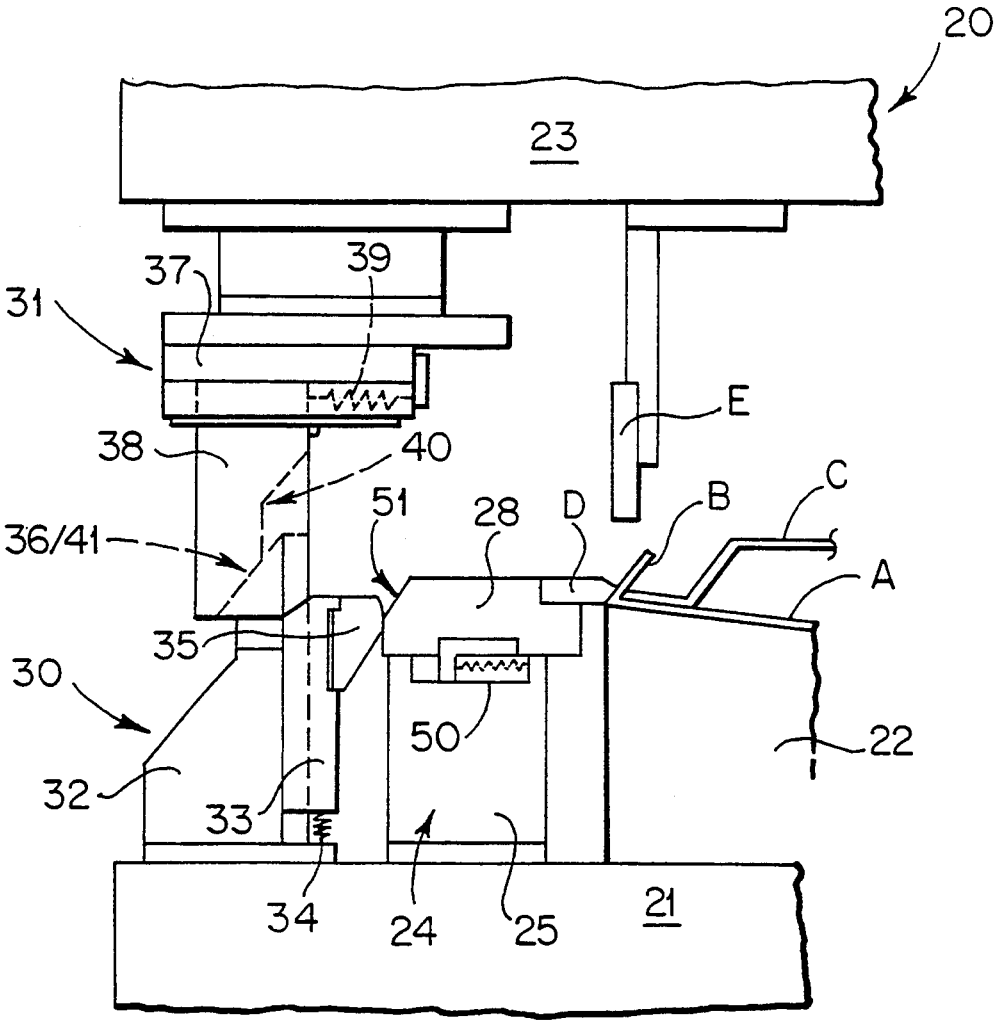
FIG. 4 is a schematic lateral view representing another embodiment of the invention.
Figure 5:
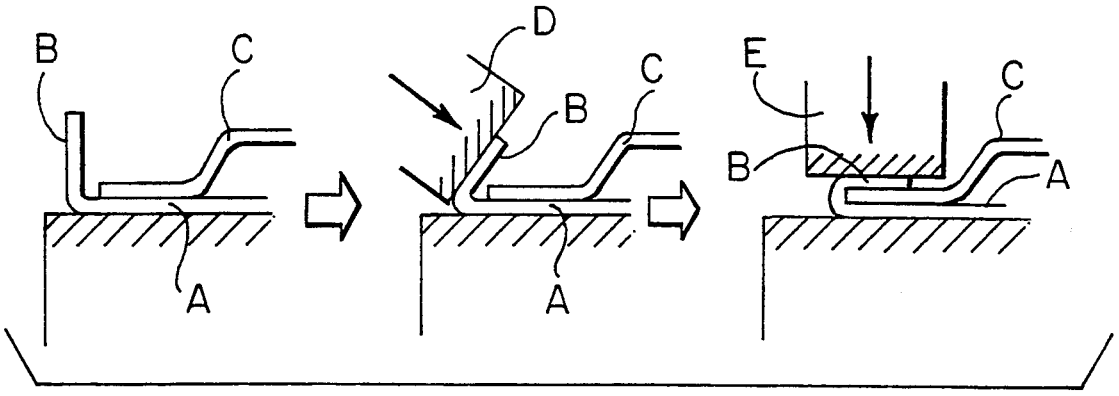
FIG. 5 is explanatory of the sequence for executing the hemming process according to the invention.
Figure 6:
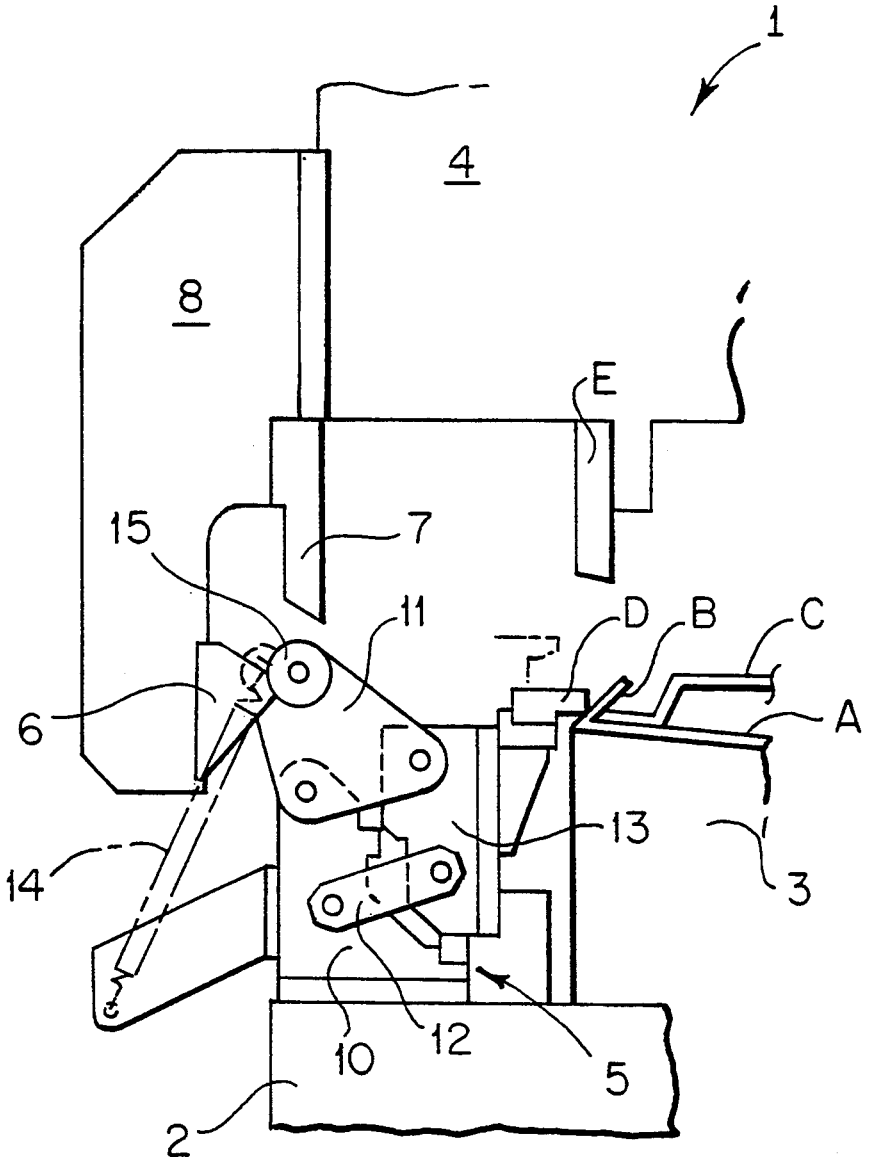
PRIOR ART FIG. 6
FIG. 6 is a schematic lateral view of a conventional apparatus for executing the hemming process.

The above description has merely referred to an embodiment of the invention by way of an example to cause the link mechanism to swingably support the moving member 28 of the pre-hemming structure 24. Nevertheless, as shown in FIG. 4, the invention may also be materialized by slidably supporting the movable member 28 so that it can slide over the top surface of the supporting frame 25 in the horizontal direction, where the movable member 28 is constantly pulled in the outward direction by a spring 50, and in addition, a cam surface 51 can be brought into contact with the transmitting cam 35 of the lower cam structure 30.

The invention has thus been described by referring to the above embodiment by way of an example of using springs as practical means for causing the movable member 28 and the lower and upper sliders 33 and 38 to be back to the initial state. Alternatively, compressed air may also be used to compose a means for causing these component members to return to the initial state.

As is apparent from the above description, the essential object of the invention is to cause the movable member of the pre-hemming structure supporting the preliminary folding blade and the transmitting cam functioning to pressure the movable member in the preliminary-folding direction to respectively return to the initial state after completion of a process for preliminarily folding a hem flange via operation of the apparatus useful for properly executing the hemming process. The improved apparatus according to the invention securely prevents the preliminary folding blade from repeatedly and ineffectively being operated on the way of lifting the upper mold, and at the same time, eliminates unwanted presence of sizable projection below the upper mold.

By virtue of the unique structure of the apparatus according to the invention, the improved apparatus can securely contract the stroke of the vertical movement of the upper mold, and yet, enables the upper mold to ascend itself at a fast speed. Owing to multiple functional effects based on those reasons described above, the apparatus can securely contract operating cycle time on the way of the hemming process. At the same time, the apparatus can securely eliminate ineffective operation of the movable member otherwise caused by unwanted contact of the transmitting cam with the pre-hemming structure to eventually prevent unwanted vibration and wear of the whole hemming facilities from occurrence, thus effectively promoting durability and service life of the whole hemming facilities.

What is claimed is:

1. An apparatus for executing a hemming process, wherein an individual inner panel is loaded on an outer panel placed on a lower mold to cause an individual hem flange previously being formed at an edge of said outer panel to be folded onto said inner panel before being superposed thereon via descending movement of an upper mold, said apparatus comprising:

a pre-hemming structure which movably supports a blade for preliminarily folding said hem flange in the hem-flange preliminary folding direction by means of a movable member movably being supported outside of said lower mold;

a lower cam structure having a lower slide base; a lower slider; means for biasing the lower slider in the upward direction and ascendingly and descendingly supported by said lower slide base; and a transmitting cam which is secured to said lower slide base for urging said movable member in the hem-flange preliminary-folding direction in association with descending movement of said lower slider;

a regular folding blade, mounted to the upper mold, secured to a position above said hem flange of said upper mold;

an upper slide structure secured to a predetermined position of said upper mold situated above said lower cam structure and comprising an upper slide base and an upper slider which is slidably supported in the horizontal direction by an upper slide base, wherein, in association with descending movement of said upper mold, a bottom surface of said upper slider coming into contact with a top surface of said lower slider to cause said lower slider to descend; and a lower sliding surface and an upper sliding surface formed on said lower slider and said upper slider, wherein, after completion of preliminarily folding said hem flange by operating said preliminary folding blade, said surfaces respectively cause said upper slider to externally slide via descending movement of said upper slider, in association with functional operation of said upper slider, to lower said upper mold to eventually cause said upper slider to leave said lower slider.

2. An apparatus for preliminarily hemming the edges of two panels together comprising:

a first mold member, including (a) a preliminary folding blade;

(b) a moveable member mounting the blade thereto;

(c) linkage means connected to the moveable member for swinging the preliminary folding blade in and out of contact with the edges to be hemmed;

(d) a stationary cam member having a first cam surface;

(e) a first slider member slidingly mounted to the stationary cam and biased in a normally extended position; and (f) a transmitting cam mounted to the first slider means and contacting a cam following member located on the linkage means;

a second mold member, including (g) a sliding cam member normally positioned in confronting, sufficiently spaced relation with the stationary cam for allowing insertion of panels between the mold members, the sliding cam member having a second cam surface for following the first cam surface when the mold members are brought together;

(h) a second slider member fixed to the sliding cam member for movement therewith, the second slider member contacting the first slider member when the mold members and the first and second cam surfaces are brought together, thereby displacing the second slider member and causing the transmitting cam to pressure the cam following member of the linkage means;

(i) pressure on the cam following member swinging the moveable member, and thus the preliminary folding blade mounted thereto, into hemming contact with the panels.

3. The apparatus described in claim 2 wherein the sliding cam member slides sufficiently to end contact of the first slider member by the second slider member thereby releasing the first slider member to its normally biased position allowing retraction of the preliminary folding blade from contact with the panels.

4. The apparatus described in claim 3 further comprising:

biasing means for returning the second slider member to a normal confronting relation with the first slider member upon termination of contact between the first and second cam surfaces which occurs when the molds are separated.

* * * * *